US010962217B1

(12) United States Patent
Zepp et al.

(10) Patent No.: US 10,962,217 B1
(45) Date of Patent: Mar. 30, 2021

(54) DECORATIVE ELECTRICALLY LIGHTED WREATH

(71) Applicants: Kevin Zepp, Moorestown, NJ (US); James Juliano, Medford, NJ (US)

(72) Inventors: Kevin Zepp, Moorestown, NJ (US); James Juliano, Medford, NJ (US)

( * ) Notice: Subject to any disclaimer, the term of this patent is extended or adjusted under 35 U.S.C. 154(b) by 0 days.

(21) Appl. No.: 17/070,088

(22) Filed: Oct. 14, 2020

Related U.S. Application Data

(60) Provisional application No. 62/916,298, filed on Oct. 17, 2019.

(51) Int. Cl.

| | |
|---|---|
| ***F21V 33/00*** | (2006.01) |
| ***F21V 23/00*** | (2015.01) |
| ***F21V 3/02*** | (2006.01) |
| *F21Y 115/10* | (2016.01) |

(52) U.S. Cl.
CPC ..... *F21V 33/0028* (2013.01); *F21V 3/02* (2013.01); *F21V 23/003* (2013.01); *F21Y 2115/10* (2016.08)

(58) Field of Classification Search
CPC ..... F21V 33/0028; F21V 23/003; F21V 3/02; F21Y 2115/10
See application file for complete search history.

(56) References Cited

U.S. PATENT DOCUMENTS

| | | | | |
|---|---|---|---|---|
| 2009/0119965 | A1* | 5/2009 | Broehl | A47G 1/14 40/721 |
| 2013/0039089 | A1* | 2/2013 | Korherr | G01D 11/28 362/551 |
| 2017/0009962 | A1* | 1/2017 | Feit | F21S 8/061 |
| 2018/0220508 | A1* | 8/2018 | Pilat | H05B 45/20 |
| 2020/0072440 | A1* | 3/2020 | Hula | F21V 23/006 |

FOREIGN PATENT DOCUMENTS

| | | | |
|---|---|---|---|
| KR | 20130125518 A | * | 11/2013 |
| KR | 20130135584 A | * | 12/2013 |

OTHER PUBLICATIONS

Machine English Translation of KR10-2013-0135584; Hui (Year: 2013).*
Machine English Translation of Kr 10-2013-0125518 A; Kook (Year: 2013).*

* cited by examiner

*Primary Examiner* — Rajarshi Chakraborty
*Assistant Examiner* — Glenn D Zimmerman
(74) *Attorney, Agent, or Firm* — Stuart M. Goldstein

(57) ABSTRACT

A decorative, electrically lighted wreath has a plurality of color changing, concentric, LED bands of light that compliment interchangeable decorative graphic inserts. The bands and inserts can be circular, elliptical, square, rectangular or any desired geometric shape. The illumination and color of the bands is modified by the user via a controller device, either manually or remotely, to coordinate with the graphic inserts. The decorative wreath device also has means to store the graphic inserts.

5 Claims, 6 Drawing Sheets

DECORATIVE ELECTRICALLY LIGHTED WREATH

RELATED APPLICATION

This application claims the benefit of provisional application Ser. No. 62/916,298, filed on Oct. 17, 2019.

FIELD OF THE INVENTION

The present invention relates to lighted decorations and more particularly to standalone outdoor or indoor lighted wreath type displays or like displays used in conjunction with natural wreaths or other decorations.

BACKGROUND OF THE INVENTION

The use of special occasion decorations, especially in outdoor settings, is very common. Utilizing various configurations of lights as decorative displays during holidays and holiday seasons is especially popular. A single decorative lighting device which has the versatility to be modified and, as a result, be displayed differently on many different occasions would be even more valuable and useful.

SUMMARY OF THE INVENTION

It is thus the object of the present invention to provide a decorative, electrically lighted wreath which can be used as a standalone decoration or in combination with other decorative members, and, additionally, which has interchangeable components which modifies the lighted displays of the device.

This and other objects of the present invention are accomplished by a decorative electrically lighted wreath that has a plurality of color changing, concentric, LED bands of light that compliment interchangeable decorative graphic inserts. The bands and inserts can be circular, elliptical, square, rectangular or any desired geometric shape. The illumination and color of the bands is modified by the user via a controller device, either manually or remotely, to coordinate with the graphic inserts. The decorative wreath device also has means to store the graphic inserts.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Decorative electrically light wreath 1 comprises base 2 having center opening 4. A plurality of concentric circular LED light bands 5-10 circumscribe opening 4. Each of the LED light bands are separated by channels 11-14. Although the herein disclosure describes circular LED light bands, the invention should not be considered so restricted. It is contemplated that the bands can be elliptical, square, rectangular or any desired geometric shape.

Figure 7:
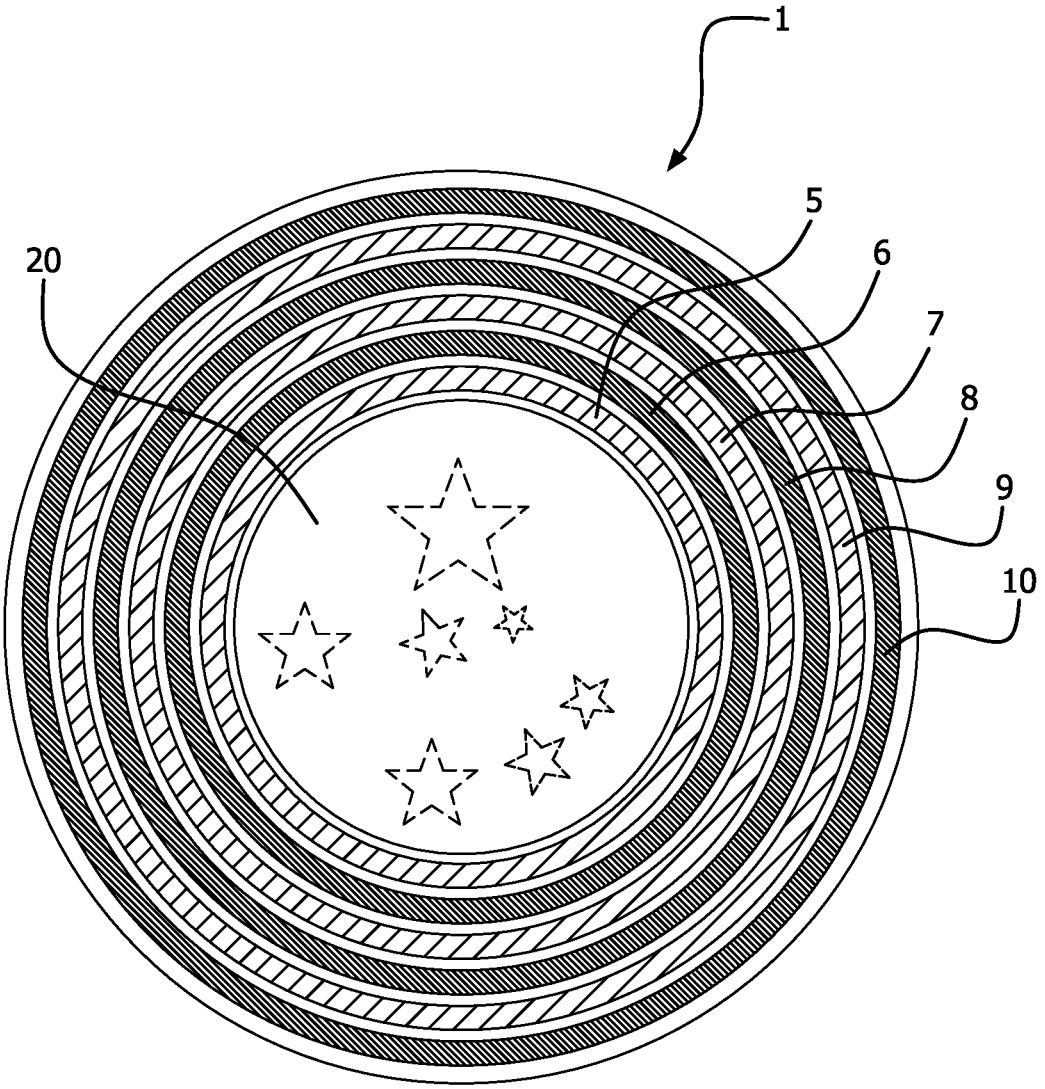
FIGS. 7 and 8 illustrate examples of the manner in which the decorative electrically lighted wreath of the present invention can be displayed.
Figure 8:
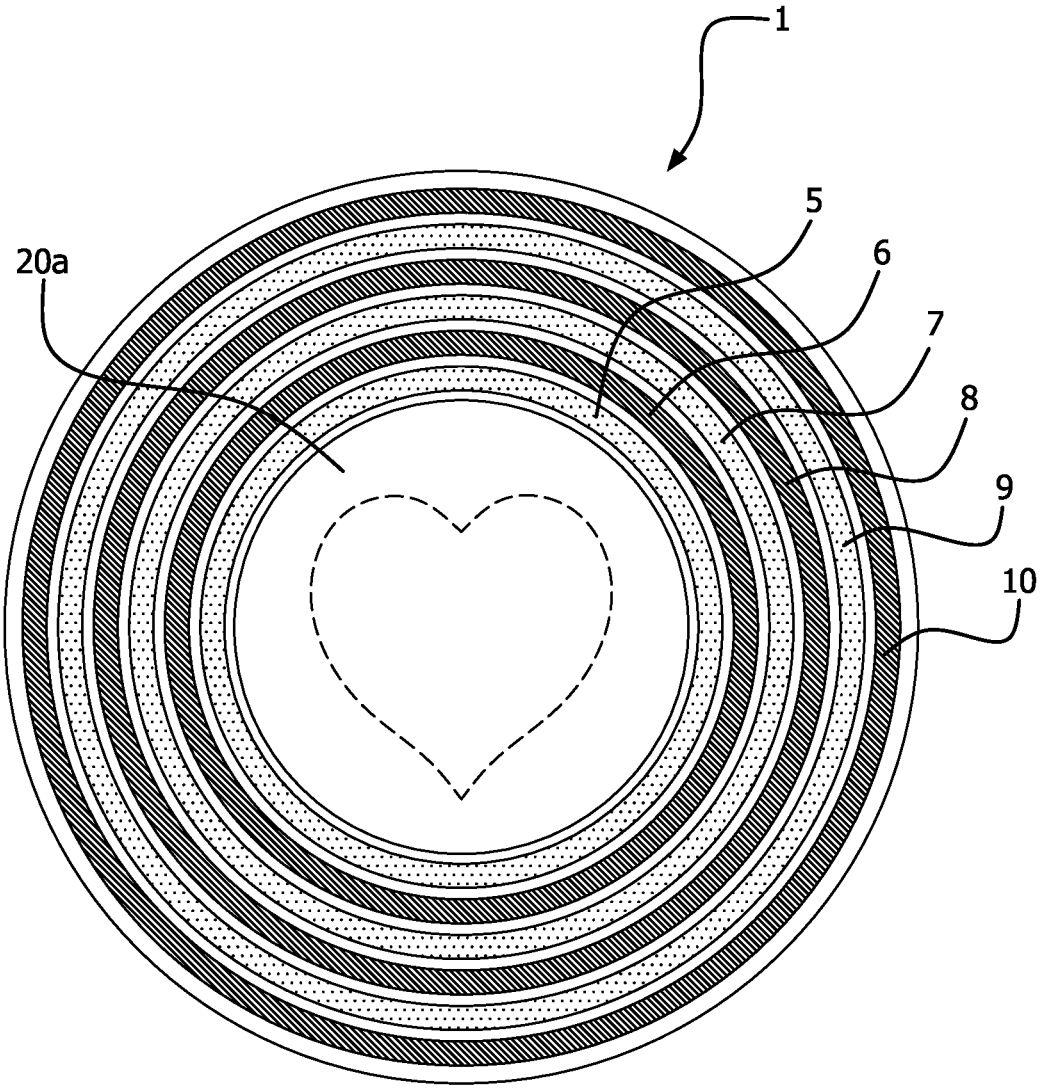

Semi-translucent cover 16, also with an opening 18, overlays base 2. Graphic insert 20 can have any desired design or representation, as seen in FIGS. 7 and 8, and it is configured to be located within opening 4. Graphic insert support 22 maintains graphic insert 20 within opening 4 by locking into the bottom of base 2. Graphic insert support 22 has through slot 24 into which extra graphic inserts, e.g. graphic insert 20*a*, can be stored.

Figure 1:
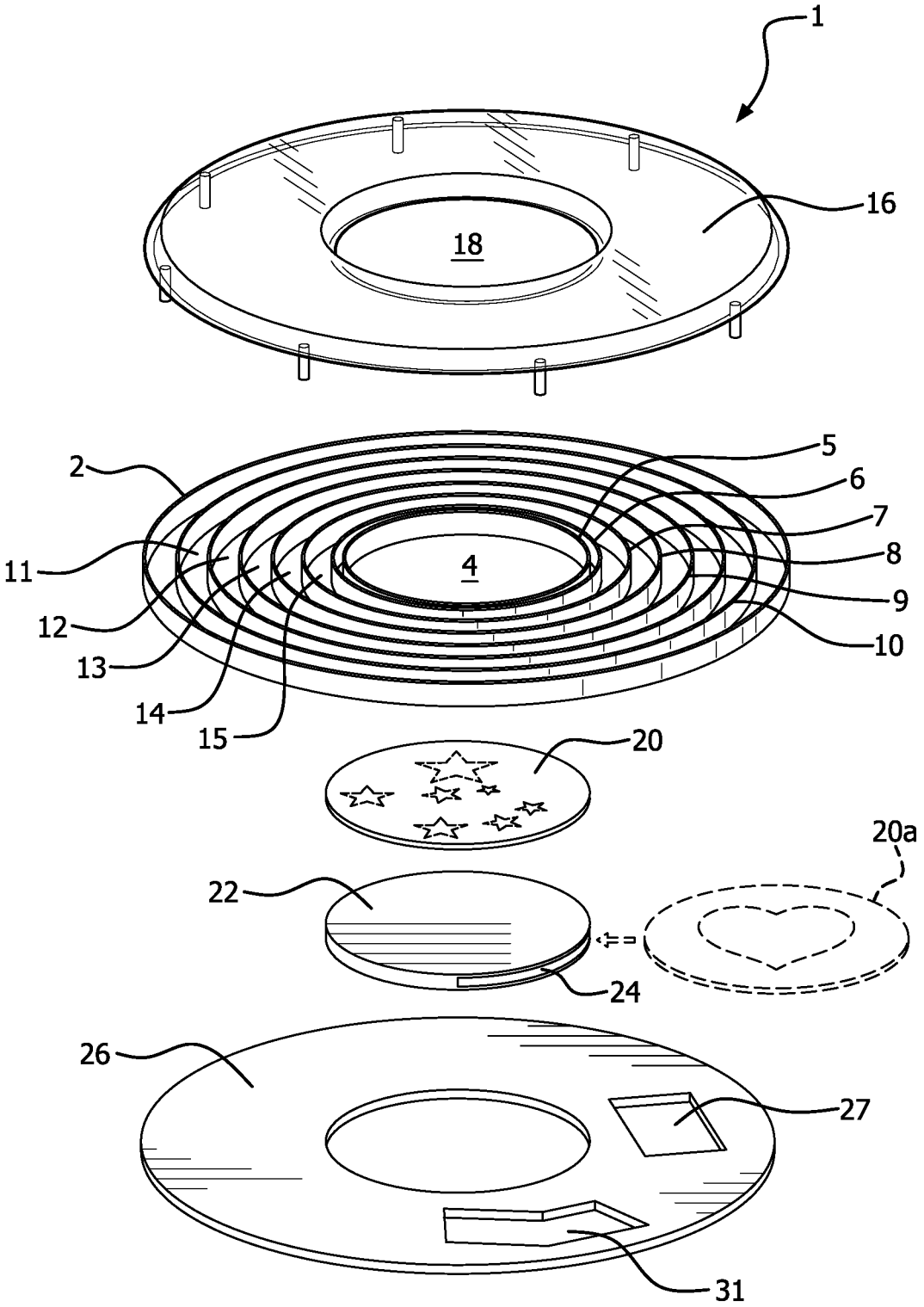
FIG. 1 is an exploded view of the components which are conjoined to form the decorative electrically lighted wreath of the present invention.
Figure 2:
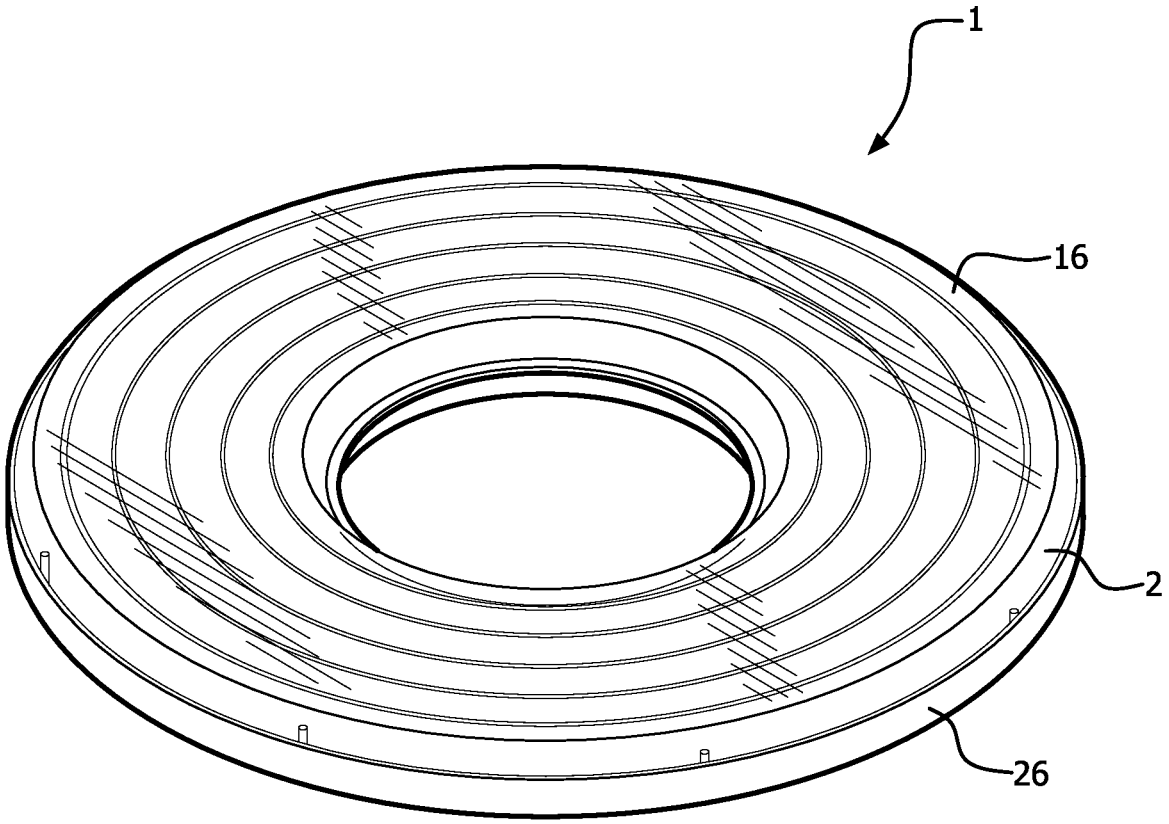
FIG. 2 is a perspective view of the decorative electrically lighted wreath of the present invention.
Figure 4:
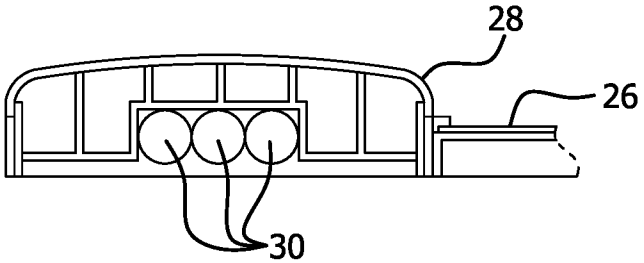
FIG. 4 is a sectional view taken from FIG. 3.
Figure 5:
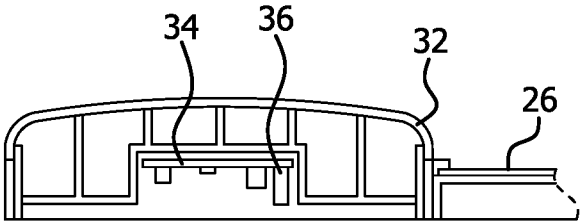
FIG. 5 is a sectional view also taken from FIG. 3.
Figure 3:
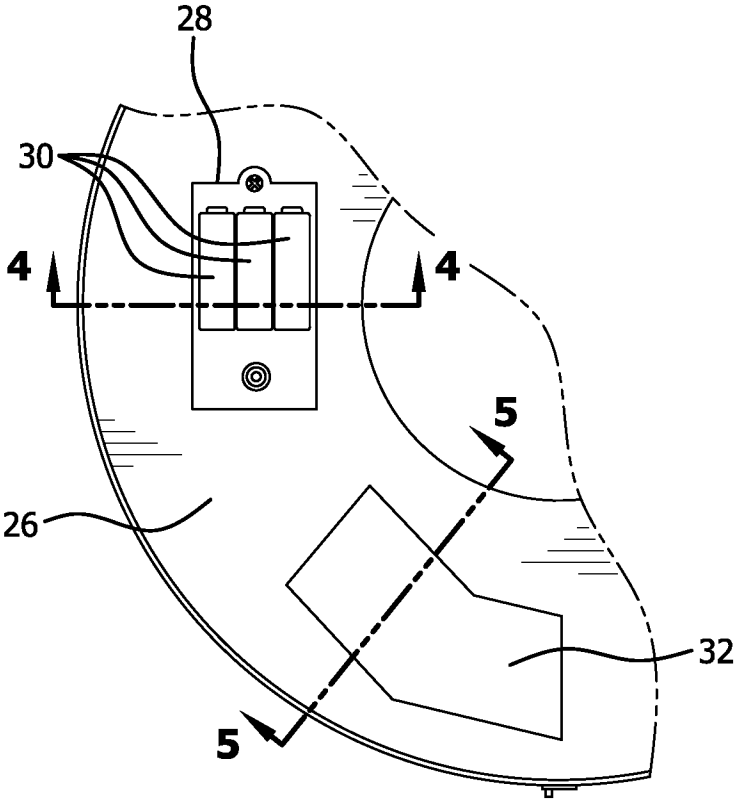
FIG. 3 is a partial sectional view of the back cover of the decorative electrically lighted wreath of the present invention.
Figure 6:
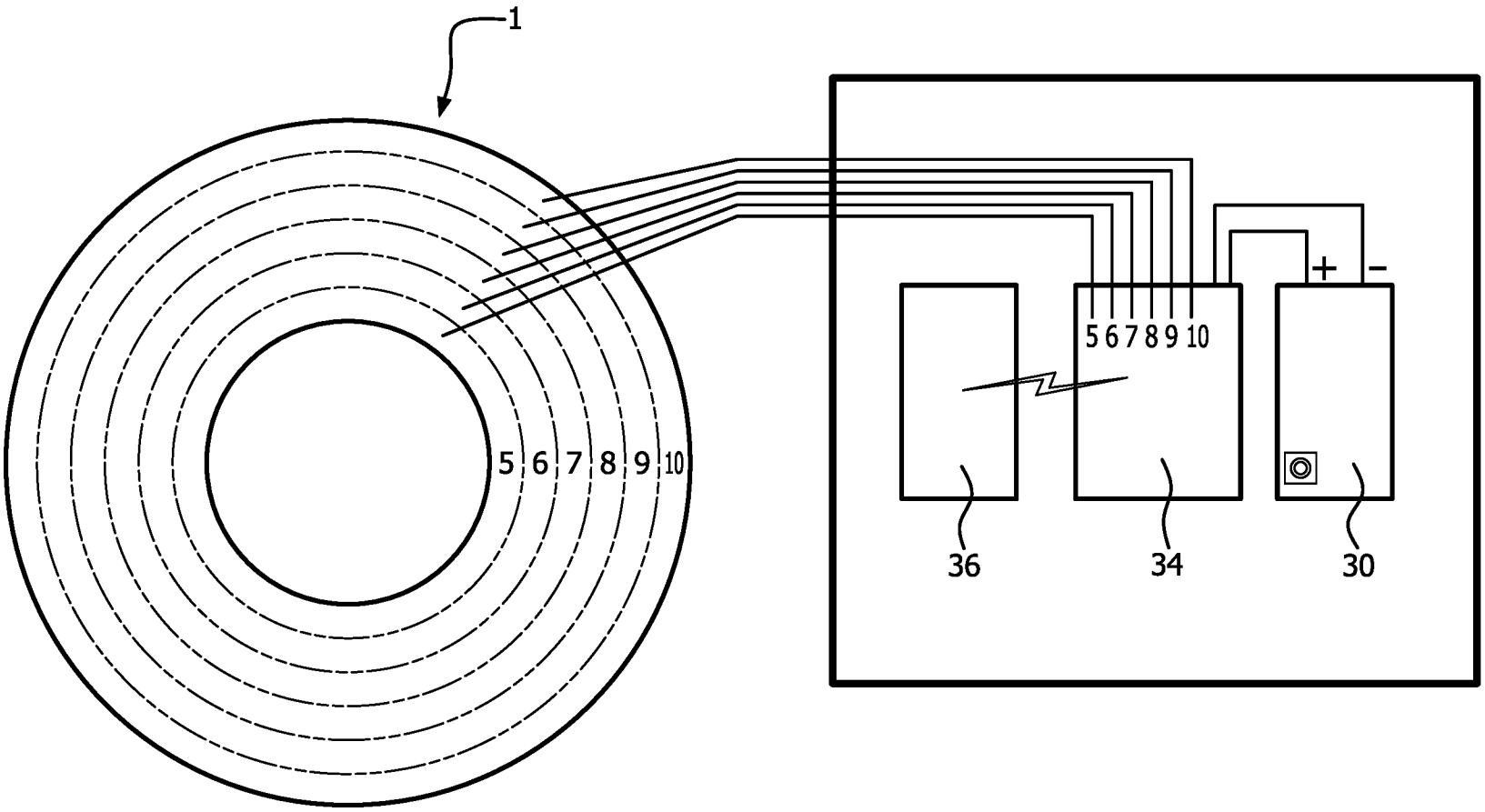
FIG. 6 is a schematic representation illustrating the electronics of the decorative electrically lighted wreath of the present invention.

Back cover 26 of wreath 1 contains compartment 28 within opening 27 for housing the electrical power source, batteries 30, and compartment 32 within opening 31 for housing electronics, including circuit board 34 and lighting controller 36. The function of controller 36, as depicted in FIG. 6, is to allow selection of each individual LED light band 5-10, to select the color of each band, and to set the band color. The bands are color changeable. The controller can be fixed in the device or be remote.

Thus, electrically lighted wreath 1 provides a decoration which can be displayed during a variety of different occasions. The ability to change the colors of light bands 5-10, in conjunction with the many different graphic inserts which would be available, establishes wreath 1 as a versatile and valuable decorative device.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A decorative electrically lighted wreath comprising:

a base having a center opening extending completely through the base and a plurality of concentric, equally spaced apart, continuous lengths of ring-shaped LED light bands of varying sizes, each light band completely circumscribing the opening, a plurality of concentric, continuously extending channels of varying sizes, each channel having a bottom surface and two sidewall surfaces perpendicular to the bottom surface and completely circumscribing the opening, each of the plurality of LED light bands being separated by one of the plurality of channels, wherein one of the plurality of light bands is closest to the opening and is the smallest of the plurality of light bands and another of the plurality of light bands is the farthest from the opening and is the longest of the plurality of light bands;

a semi-translucent cover completely overlaying the base; and a back cover containing electronic components for controlling the color and illumination of the LED light bands and a power source for providing electrical power to the electronic components.

2. The decorative electrically lighted wreath as in claim 1 further comprising a graphic insert located within the center opening and a graphic insert support for maintaining the graphic insert within the opening.

3. The decorative electrically lighted wreath as in claim 1 wherein the electronic components comprise a lighting controller connected to a circuit board and the power source for controlling the illumination and colors of each of the LED light bands.

4. The decorative electrically lighted wreath as in claim 2 wherein the graphic insert support is configured to store graphic inserts.

5. The decorative electrically lighted wreath as in claim 3 further comprising a graphic insert located within the center opening and a graphic insert support for maintaining the graphic insert within the opening.

* * * * *